US005688193A

United States Patent [19]

Kasasima et al.

[11] Patent Number: 5,688,193

[45] Date of Patent: Nov. 18, 1997

[54] GOLF BALL AND MOLD THEREFOR

[75] Inventors: Atuki Kasasima; Keisuke Ihara; Hirotaka Shimosaka; Michio Inoue, all of Chichibu, Japan

[73] Assignee: Bridgestone Sports Co., Ltd., Tokyo, Japan

[21] Appl. No.: 680,839

[22] Filed: Jul. 16, 1996

[30] Foreign Application Priority Data

Jul. 17, 1995 [JP] Japan ..... 7-202816

[51] Int. Cl.[6] ..... A63B 37/14

[52] U.S. Cl. ..... 473/379; 249/60; 425/408; 425/542

[58] Field of Search ..... 473/379; 425/408, 425/542; 249/60

[56] References Cited

U.S. PATENT DOCUMENTS 4,090,716 5/1978 Martin et al. ..... 473/379

5,192,078 3/1993 Woo ..... 473/379

5,249,804 10/1993 Sanchez ..... 473/379

*Primary Examiner*—George J. Marlo

*Attorney, Agent, or Firm*—Sughrue,Mion,Zinn,Macpeak & Seas, PLLC

[57] ABSTRACT

In a golf ball of the icosahedral dimple arrangement pattern having twenty identical phantom regular triangles projected on its spherical surface, all dimples are arranged within the triangles such that no dimples may intersect the sides of each triangle and a great circle which does not intersect the dimples at all may not be depicted. Some dimples may be arranged at the apexes of each triangle. The golf ball travels a longer distance and provides consistent flight independent of impact points. Also provided is a mold consisting of upper and lower mold cups whose cavity surface is provided with dimple-forming protrusions such that the inventive dimple arrangement may be accomplished. The mold is easy to design and fabricate.

4 Claims, 3 Drawing Sheets

GOLF BALL AND MOLD THEREFOR

BACKGROUND OF THE INVENTION

1. Field of the Invention

This invention relates to a golf ball having a uniform arrangement of dimples and providing consistent flight independent of impact points and a mold for use in the preparation of such golf balls.

2. Prior Art

It is desired that golf balls have a uniform arrangement of dimples on their spherical surface and provide consistent flight independent of impact points. For the arrangement of dimples on golf balls, there are known various arrangement patterns such as icosahedral and dodecahedral arrangement patterns. Since the mold for molding golf balls typically consists of two mold cups which are mated at a parting line, most golf balls have at least one great circle which corresponds to the parting line of the mold and does not intersect the dimples at all.

FIG. 5 illustrates one exemplary golf ball of the icosahedral arrangement pattern wherein dimples are arranged such that six great circles A may be formed. For the icosahedral arrangement pattern, there are known such a dimple arrangement permitting six great circles to be formed and a modified dimple arrangement wherein the arrangement of dimples near the parting line is tailored so that only one great circle may be formed. These golf balls having great circles suffer from inevitable flight variations with impact points even when the dimple arrangement is made as uniform as possible by depicting six great circles.

Japanese Patent Application Kokai (JP-A) Nos. 173907/1986 and 47379/1987 disclose a mold consisting of two mold cups wherein the parting line is corrugated so as to pass by those dimples lying on a normal straight parting line. Using this mold, a golf ball free of a great circle which does not intersect dimples can be molded. The design and fabrication of this mold including a dimple arrangement are very difficult and have not been used in practice.

SUMMARY OF THE INVENTION

An object of the invention is to provide a golf ball which has a plurality of dimples uniformly arranged on its spherical surface, is free of a great circle which does not intersect the dimples, and offers consistent flight independent of impact points. Another object of the invention is to provide a mold for use in the preparation of such a golf ball.

The present invention provides a golf ball of the icosahedral dimple arrangement pattern having twenty identical phantom regular triangles projected on its spherical surface. In a first form of the invention, the dimples are arranged within the triangles such that no dimples may intersect the sides of each triangle and a great circle which does not intersect the dimples at all may not be depicted.

In a second form of the invention, some dimples are arranged at the apexes of each triangle and the remaining dimples are arranged within the triangles such that no dimples may intersect the sides of each triangle and a great circle which does not intersect the dimples at all may not be depicted.

The present invention also provides a mold for molding a golf ball comprising two mold cups which are mated in a separable manner to define a spherical cavity therebetween. In a third form of the invention, the mold having twenty identical phantom regular triangles projected on the spherical cavity surface in the icosahedral dimple arrangement pattern is substantially equally divided into two mold cups along the sides of the triangles. The cavity surface of each mold cup is provided with dimple-forming protrusions within each triangle such that no protrusions may intersect the sides of each triangle and a great circle which does not intersect the protrusions at all may not be depicted when the mold cups are mated.

In a fourth form, the mold having twenty identical phantom regular triangles projected on the spherical cavity surface in the icosahedral dimple arrangement pattern is substantially equally divided into two along a parting line connecting the sides of the triangles. The parting line edges of the mold cups at a position corresponding to the apex of the triangle are formed with a notch of a shape corresponding to the planar shape of a dimple. A pin having an inner end configured into a convex shape capable of forming a dimple is fitted in the notch. The cavity surface of each mold cup is provided with dimple-forming protrusions at positions corresponding to the apexes of the triangles except for those on the parting line and within each triangle such that no protrusions may intersect the sides of each triangle and a great circle which does not intersect the protrusions at all may not be depicted when the mold cups are mated.

According to the first and second forms of the invention, the golf ball is free of a great circle which does not intersect the dimples at all and permits dimples to be uniformly arranged on its spherical surface. The dimple design of the invention does not interfere with the icosahedral dimple arrangement pattern. Consequently, the golf ball of the invention ensures improved aerodynamics and an increased carry as compared with conventional golf balls. Additionally, the golf ball experiences no change of flight with impact points and maintains directional stability on flight.

Each of the molds of the third and fourth form is effective for molding such golf balls. Although the parting line edge of each mold cup is an alternately folded (or polygonal) line, the mold is divided along the sides of triangles in contrast to the corrugated parting edge staggered around dimples in the prior art seamless ball-forming mold, leading to easy design and fabrication of the mold and easy formation of dimple-forming protrusions.

In one preferred embodiment of the mold according to the fourth form wherein the pins are mounted for movement into and out of the mold cavity, the pins serve as both core supporting pins and dimple forming pins. When a cover is formed around a core which is placed and centered in the mold cavity, the pins can serve as support pins for positioning the core at the center. When the pins are retracted such that their inner end is coextensive with the cavity surface, the inner end forms a part of the cavity surface. The pins serve to form dimples on the cover at apexes of triangles.

BRIEF DESCRIPTION OF THE DRAWINGS

These and further features of the present invention will be apparent with reference to the following description and drawings, wherein.

DETAILED DESCRIPTION OF THE INVENTION

Figure 1:
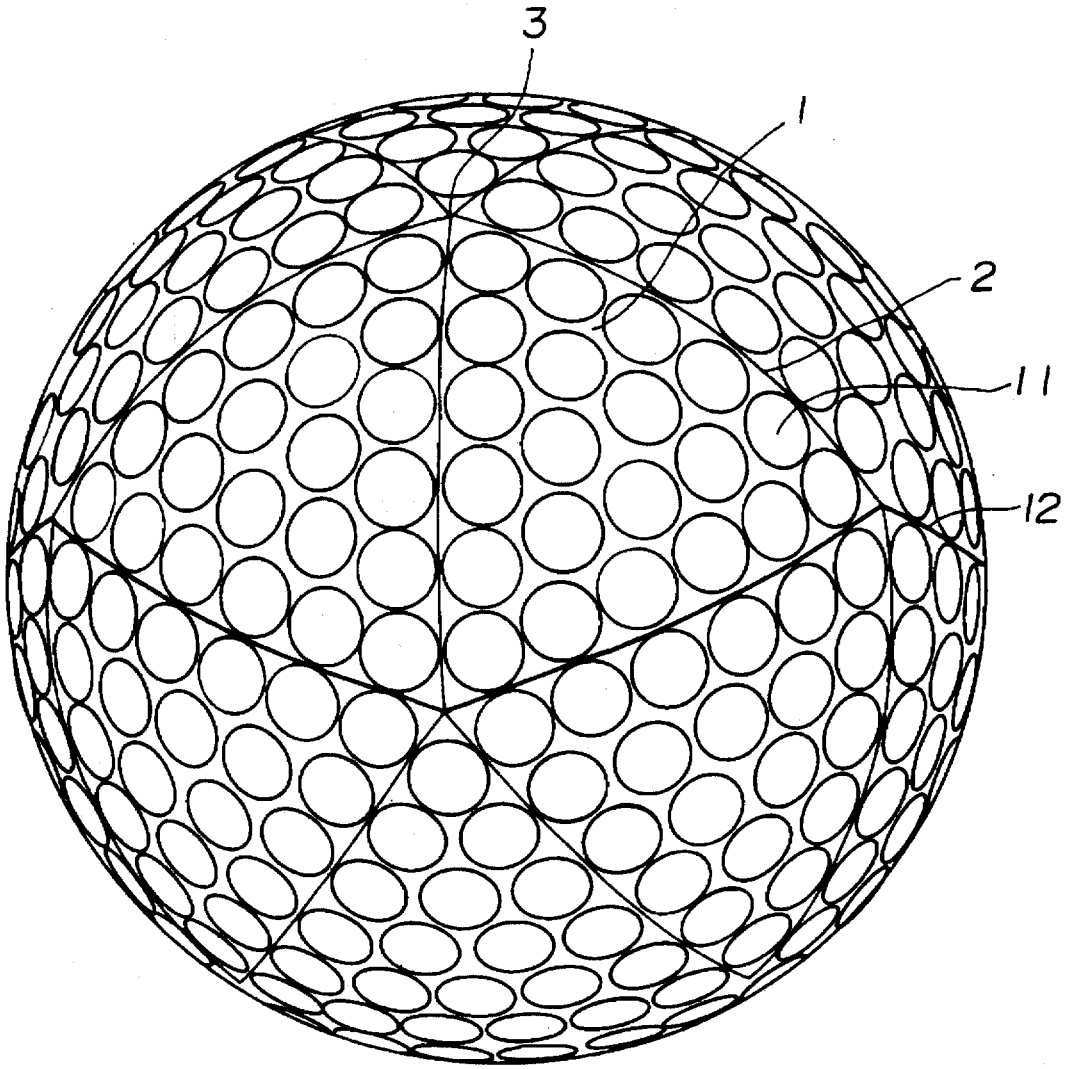
FIG. 1 is a schematic perspective view of a golf ball according to one embodiment of the invention.

Referring to FIG. 1, there is illustrated a golf ball according to one embodiment of the invention. This golf ball is of the icosahedral dimple arrangement pattern having twenty identical phantom regular triangles 1 projected on its spherical surface. Each triangle 1 has three sides 2 and three apexes 3. All dimples 11 are arranged within the regular triangles 1. According to the invention, the dimples 11 are arranged within the regular triangles 1 such that no dimples may intersect the sides 2 of each triangle 1 and a great circle which does not intersect the dimples 11 at all may not be depicted. No dimples are positioned at the apexes 3 of the triangles 1.

Figure 2:
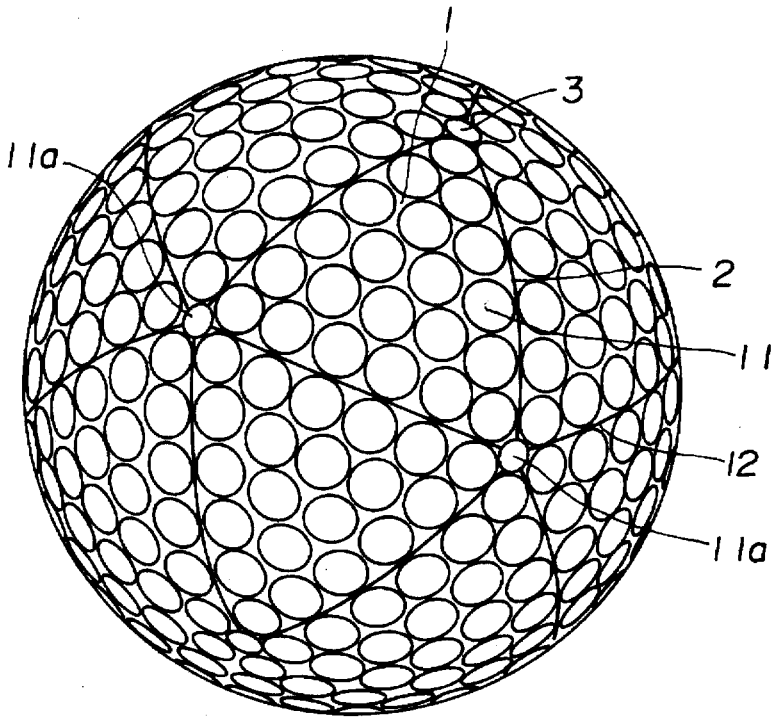
FIG. 2 is a schematic perspective view of a golf ball according to another embodiment of the invention.

FIG. 2 illustrates a golf ball according to another embodiment of the invention. The dimple arrangement of this golf ball is the same as that of FIG. 1 except that dimples 11*a* are also positioned at the apexes 3 of the triangles 1.

In the golf ball of the invention, the number of dimples contained in each regular triangle is preferably 10 to 36, especially 15 to 28. Then the total number of dimples is preferably 200 to 720, especially 300 to 560. In the embodiment of FIG. 2, twelve dimples at the apexes of the triangles are added, with the preferred total number of dimples ranging between 200+12 and 720+12.

Preferably the planar shape of dimples is a circle and they have a diameter of 2 to 5 mm and a depth of 0.1 to 0.3 mm. All the dimples may have an identical diameter and an identical depth while two or more types of dimples having different diameters and/or depths may be used in admixture.

Since a great circle which does not intersect the dimples at all is not depictable and dimples are uniformly arranged on its spherical surface, either of the above-illustrated golf balls has improved aerodynamics and offers an increased carry as compared with conventional golf balls. The golf ball of the invention ensures consistent flight independent of impact points.

Figure 3:
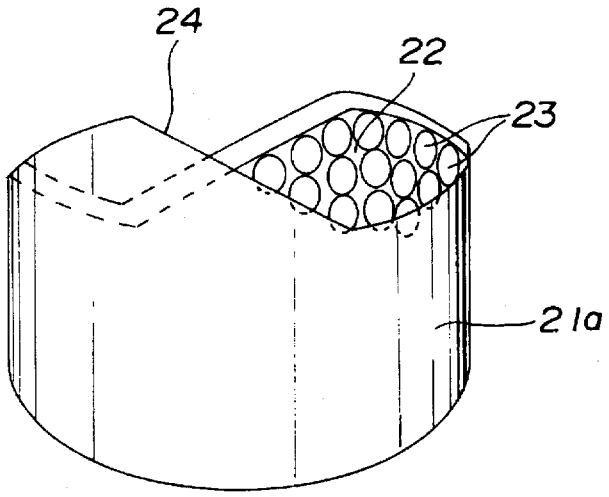
FIG. 3 is a schematic perspective view of a golf ball-forming mold according to one embodiment of the invention.
Figure 4:
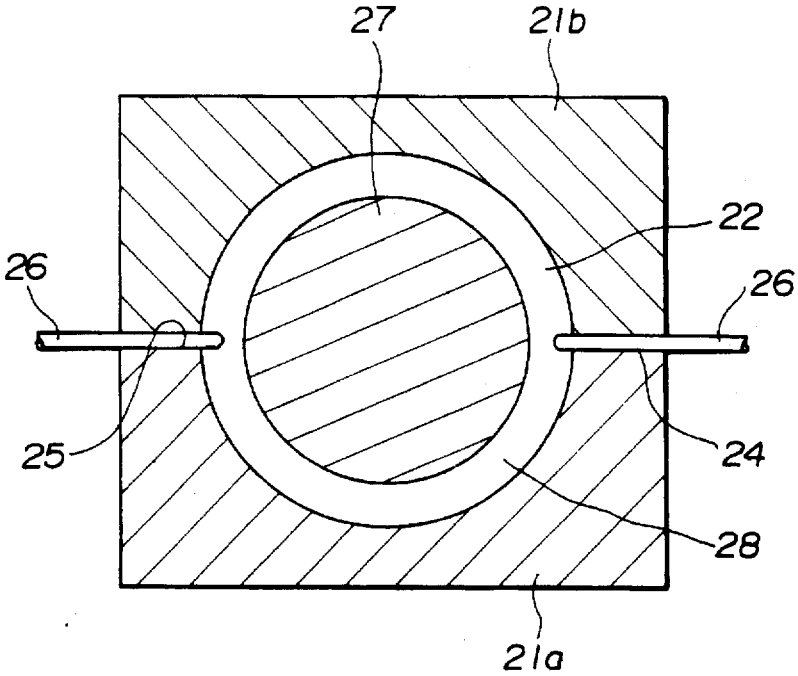
FIG. 4 is a schematic cross-sectional view of a golf ball-forming mold according to another embodiment of the invention.
Figure 5:
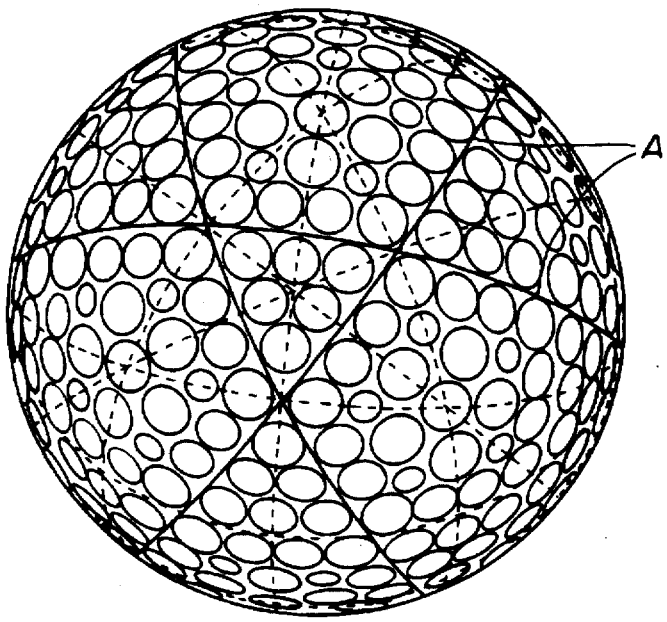
FIG.5 PRIOR ART
FIG. 5 is a schematic perspective view of a prior art golf ball of the icosahedral dimple arrangement pattern.

Referring to FIG. 3, there is illustrated a golf ball-forming mold according to one embodiment of the invention. The mold for molding a golf ball includes two mold cups 21*a* and 21*b* which are mated along a parting line in a separable manner to define a spherical cavity 22 therebetween. Since upper and lower mold cups 21*a* and 21*b* are of the same construction, only the lower mold cup 21*a* is illustrated in FIG. 3 and described hereinafter. Twenty identical phantom regular triangles are projected on the spherical cavity surface 22 in accordance with the icosahedral arrangement pattern of the golf ball as illustrated in conjunction with FIG. 1. The mold is substantially equally divided into two cups 21*a* and 21*b* along the sides of the regular triangles. The cavity surface 22 of each mold cup is provided with dimple-forming protrusions 23 within each triangle such that no protrusions may intersect the sides of each triangle and a great circle which does not intersect the protrusions 23 at all may not be depicted when the mold cups are mated. The parting line edges 24 of the mold cups are engageable with each other and in the form of an alternately folded or polygonal line. Then a golf ball obtained using this mold has a parting line 12 in the form of an alternately folded or polygonal line as shown in FIG. 1.

The mold for producing the golf ball shown in FIG. 2 is the same as that shown in FIG. 3 except that dimple-forming protrusions are also provided at positions corresponding to the apexes of the phantom regular triangles. The parting line edges 24 of the mated mold cups 21*a* and 21*b* at the positions corresponding to the apexes of the triangles lying on the parting line are formed with notches 25 of a shape corresponding to the planar shape of the dimples to be formed at the triangle apexes. The notch as a whole is cylindrical in the illustrated embodiment. Pins 26 each having an inner end configured into a convex shape capable of forming a dimple are fitted in the notches 25. The pins 26 may be either of the fixed and retractable types. That is, the pins 26 is fixed such that their inner end is at a position corresponding to the depth of the dimples. Alternatively, the pins 26 are retractable such that they serve as both support pins and dimple-forming pins. In the molding step wherein a golf ball core 27 is placed in the mold cavity 22 and a cover molding stock is fed into the space 28 between the core 27 and the cavity surface to mold a golf ball cover, the pins 26 are moved into the mold cavity 22 to support the core 27. Immediately before the feed of the cover stock into the space 28 is completed, the pins 26 are retracted until their inner end is coextensive with the cavity surface. The inner ends of the pins 26 form parts of the cavity surface. Then dimples corresponding to the inner ends of the pins 26 are formed at positions corresponding to the apexes of the triangles and on the parting line.

Since the parting edges of the mold cups are alternately folded along the sides of the regular triangles and no dimple-forming protrusions intersect the sides, the design and fabrication of the mold are easy. Where dimples are formed at positions corresponding to the apexes of the triangles along the parting line, pins are disposed at the corresponding positions as mentioned above. The step required for the additional pins is approximately equal to the step required for disposing conventional support pins in the design and fabrication of conventional molds. Then the addition of the pins does not complicate the design and fabrication of the mold. The mold can be fabricated without a substantial cost increase.

Using the mold mentioned above, golf balls can be produced in a conventional manner by either injection molding or compression molding.

There has been described a golf ball having an improved dimple arrangement based on the icosahedral pattern which will travel a longer distance and provide consistent flight independent of impact points. The mold of the invention is best suited for the manufacture of such golf balls and itself is easy to design and fabricate.

Japanese Patent Application No. 202816/1995 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. In a golf ball of the icosahedral dimple arrangement pattern having twenty identical phantom regular triangles projected on its spherical surface, the improvement wherein the dimples are arranged within the triangles such that no dimple may intersect the sides of each said triangle and a great circle which does not intersect the dimples at all may not be depicted.

2. In a golf ball of the icosahedral dimple arrangement pattern having twenty identical phantom regular triangles projected on its spherical surface, the improvement wherein some dimples are arranged at the apexes of each said triangle and the remaining dimples are arranged within the triangles such that none of said remaining dimples may intersect the sides of each said triangle and a great circle which does not intersect the dimples at all may not be depicted.

3. In a mold for molding a golf ball comprising two mold cups which are mated in a separable manner to define a spherical cavity therebetween, the improvement wherein the mold having twenty identical phantom regular triangles projected on the spherical cavity surface in the icosahedral dimple arrangement pattern is substantially equally divided into two mold cups along the sides of the triangles, and the cavity surface of each mold cup is provided with dimple-forming protrusions within each said triangle such that no protrusions may intersect the sides of each said triangle and a great circle which does not intersect the protrusions at all may not be depicted when the mold cups are mated.

4. In a mold for molding a golf ball comprising two mold cups which are mated in a separable manner to define a spherical cavity therebetween, the improvement wherein the mold having twenty identical phantom regular triangles projected on the spherical cavity surface in the icosahedral dimple arrangement pattern is substantially equally divided into two along a parting line connecting the sides of the triangles, the parting line edges of the mold cups at a position corresponding to the apex of the triangle are formed with a notch of a shape corresponding to the planar shape of a dimple, a pin having an inner end configured into a convex shape capable of forming a dimple is fitted in the notch, and the cavity surface of each mold cup is provided with dimple-forming protrusions at positions corresponding to the apexes of the triangles except for those on the parting line and within each said triangle such that no protrusions may intersect the sides of each said triangle and a great circle which does not intersect the protrusions at all may not be depicted when the mold cups are mated.

* * * * *